US009880482B2

(12) United States Patent
Hasegawa et al.

(10) Patent No.: US 9,880,482 B2
(45) Date of Patent: Jan. 30, 2018

(54) ULTRAVIOLET-CURABLE LIQUID DEVELOPER AND METHOD OF PRODUCING SAME

(71) Applicant: CANON KABUSHIKI KAISHA, Tokyo (JP)

(72) Inventors: Waka Hasegawa, Tokyo (JP); Ryo Natori, Tokyo (JP); Ayano Mashida, Kawasaki (JP); Junji Ito, Hiratsuka (JP); Yasuhiro Aichi, Tokyo (JP); Jun Shirakawa, Kawaguchi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/166,709

(22) Filed: May 27, 2016

(65) Prior Publication Data

US 2016/0349656 A1 Dec. 1, 2016

(30) Foreign Application Priority Data

May 27, 2015 (JP) ..... 2015-107304

(51) Int. Cl.

| | |
|---|---|
| ***G03G 9/08*** | (2006.01) |
| ***G03G 9/13*** | (2006.01) |
| ***G03G 9/125*** | (2006.01) |
| ***G03G 9/135*** | (2006.01) |
| *G03G 15/10* | (2006.01) |

(52) U.S. Cl.

CPC ..... *G03G 9/131* (2013.01); *G03G 9/0806* (2013.01); *G03G 9/125* (2013.01); *G03G 9/13* (2013.01); *G03G 9/132* (2013.01); *G03G 9/135* (2013.01); *G03G 9/1355* (2013.01); *G03G 15/10* (2013.01)

(58) Field of Classification Search

CPC ..... G03G 9/131; G03G 9/132; G03G 9/1355
USPC ..... 430/115
See application file for complete search history.

(56) References Cited

U.S. PATENT DOCUMENTS

| | | | |
|---|---|---|---|
| 5,364,726 | A | 11/1994 | Morrison et al. |
| 7,833,687 | B2 | 11/2010 | Kato et al. |
| 8,697,327 | B2 | 4/2014 | Shibata et al. |

(Continued)

FOREIGN PATENT DOCUMENTS

| | | |
|---|---|---|
| EP | 2 911 004 | 8/2015 |
| JP | 0626078 A | 8/1994 |

(Continued)

OTHER PUBLICATIONS

Y. Harasaki, "Coating Basics and Engineering", Converting Technical Institute, p. 53, Table 3.9.

(Continued)

*Primary Examiner* — Mark A Chapman
(74) *Attorney, Agent, or Firm* — Fitzpatrick Cella Harper and Scinto

(57) ABSTRACT

The ultraviolet-curable liquid developer contains a hydrophobic cationically polymerizable liquid monomer, a photopolymerization initiator, a toner particle insoluble in the liquid monomer, and a toner particle dispersing agent, wherein the toner particle contains a binder resin that has an acid value of at least 5 mg KOH/g; the toner particle dispersing agent is a polymer that contains at least both a monomer unit represented by general formula (1) and a monomer unit represented by general formula (2); and the toner particle dispersing agent has a monomer unit represented by general formula (1) at a position other than the terminal position.

10 Claims, 1 Drawing Sheet

(56) References Cited

U.S. PATENT DOCUMENTS

| | | | |
|---|---|---|---|
| 8,722,302 | B2 | 5/2014 | Maeda et al. |
| 8,815,484 | B2 | 8/2014 | Tanaka et al. |
| 9,057,970 | B2 | 6/2015 | Ida et al. |
| 9,229,345 | B2 | 1/2016 | Ikeda et al. |
| 9,348,247 | B2 | 5/2016 | Ida et al. |
| 2004/0021753 | A1 | 2/2004 | Yoshihiro et al. |
| 2010/0055602 | A1 | 3/2010 | Teshima |
| 2014/0356779 | A1 | 12/2014 | Hasegawa et al. |
| 2014/0377697 | A1 | 12/2014 | Nishiura et al. |
| 2015/0004539 | A1 | 1/2015 | Watanabe et al. |
| 2015/0192875 | A1 | 7/2015 | Ito et al. |
| 2015/0274853 | A1 | 10/2015 | Nishiura et al. |
| 2015/0277254 | A1 | 10/2015 | Mukumoto et al. |
| 2015/0370190 | A1 | 12/2015 | Ikedo et al. |

FOREIGN PATENT DOCUMENTS

| | | | |
|---|---|---|---|
| JP | 2002012607 | A | 1/2002 |
| JP | 2002188025 | A | 7/2002 |
| JP | 2003026978 | A | 1/2003 |
| JP | 3442406 | B2 | 9/2003 |
| JP | 2003342503 | A | 12/2003 |
| JP | 2010060849 | A | 3/2010 |
| JP | 5148621 | B2 | 2/2013 |
| JP | 5277800 | B2 | 8/2013 |
| WO | 01/18608 | | 3/2001 |
| WO | 2014/061747 | | 4/2014 |
| WO | 2014/123121 | | 8/2014 |

OTHER PUBLICATIONS

S. Ito, "Dictionary of Pigments", pp. 345-349, Main text and Figs. II.3.73-II.4.75.

S. Ito, "Dictionary of Pigments", pp. 258-263, 282-285, 290-291, 294-295, pp. 306-307, pp. 314-315, pp. 320-321, pp. 326-335, pp. 338-349, Main text and Figs. II.3.73-II.4.73.

W. Herbst, et al., "Industrial Organic Pigments", List of Commercially Available Pigments, pp. 637-645.

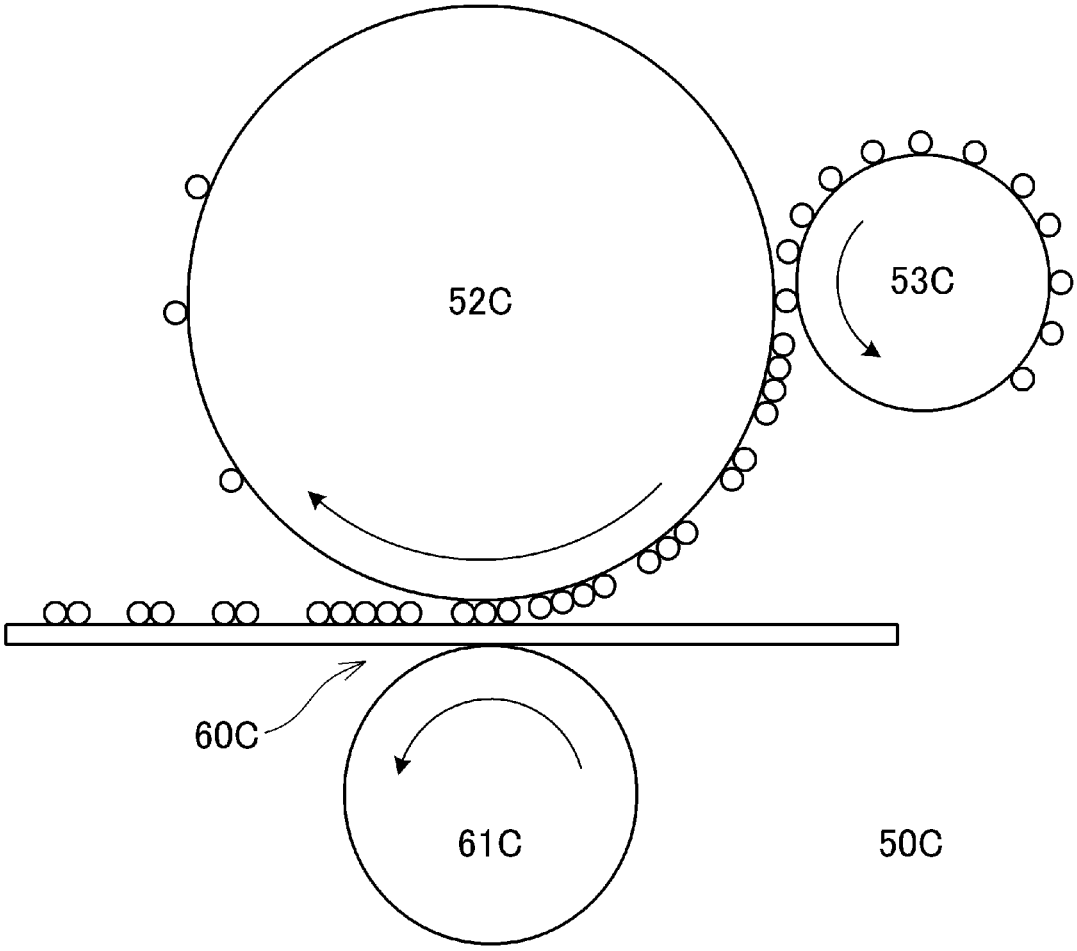
52C
53C
60C
61C
50C

ULTRAVIOLET-CURABLE LIQUID DEVELOPER AND METHOD OF PRODUCING SAME

BACKGROUND OF THE INVENTION

Field of the Invention

The present invention relates to a liquid developer for use in image-forming apparatuses that utilize an electrophotographic system, e.g., electrophotography, electrostatic recording, electrostatic printing, and so forth.

Description of the Related Art

Plate-based presses have in the past been used to produce printed material for which a certain number of copies are required, such as regional advertising, internally distributed corporate documents, and large posters. In place of these conventional presses, on-demand presses have entered into use in recent years; these on-demand presses can rapidly respond to a diversifying range of needs and support inventory reductions. Electrophotographic printers that use a dry developer or a liquid developer and inkjet printers capable of high speeds and high quality printing are anticipated for such on-demand printers.

Dry developers currently occupy the developer mainstream due to their handling advantages, which derive from the fact that a solid developer is being handled. However, viewed from the standpoint of preventing the image deterioration caused by changes in the environment, e.g., temperature and humidity, the environmental stability of the charging performance has been a problem with dry developers. In addition, the colored resin particles in a dry developer readily undergo aggregation during, for example, storage, and uniformity when the colored resin particles are dispersed has been a problem. In addition, with regard to their properties, when the colored resin particle diameter is made relatively small in pursuit of high resolution, the problems deriving from the fact that a powder is involved as described above become even more substantial.

Liquid developers, on the other hand, use an electrically insulating liquid as a carrier liquid and because of this are more resistant than dry developers to the problem of aggregation of the colored resin particles in the liquid developer during storage, and a microfine toner can thus be used. As a result, liquid developers provide a better fine line image reproducibility and a better gradation reproducibility than dry developers and are characterized by an excellent color reproducibility and also excellence in high-speed image-forming methods. Development is becoming quite active with regard to high-image-quality, high-speed digital printing apparatuses that exploit these excellent features by utilizing electrophotographic technologies that use liquid developers. In view of these circumstances, there is demand for the development of liquid developers that have even better properties.

A liquid developer production method has been disclosed in which, using a coacervation method, colored resin particles are dispersed in an insulating hydrocarbon dispersion medium in the presence of an acid group-containing resin and a compound that is the reaction product of a polyamine compound and a hydroxycarboxylic acid self-condensate (Japanese Patent No. 5,148,621). A liquid developer as disclosed in Japanese Patent No. 5,148,621 requires the removal of the electrically insulating liquid since a substantial deterioration in the appearance of the image ends up being caused when the electrically insulating liquid remains on the recording medium, e.g., paper or plastic film. A method generally used to remove the electrically insulating liquid has been the application of thermal energy to evaporate and remove the electrically insulating liquid, but this has not necessarily been desirable from an environmental standpoint, e.g., the vapor of a volatile organic solvent is emitted from the machine at this point and large amounts of energy are consumed.

To counter this, a method has been introduced in which the electrically insulating liquid is cured by photopolymerization. This photopolymerizable liquid developer uses a reactive functional group-bearing monomer or oligomer as the electrically insulating liquid, and a photopolymerization initiator is also added and dissolved thereinto. This photopolymerizable liquid developer is capable of high speeds because it is cured by a polymerization reaction induced by the irradiation of light, e.g., ultraviolet radiation, on the photopolymerizable liquid developer.

Such a photopolymerizable liquid developer has been disclosed in the form of a photopolymerizable liquid developer containing a toner particle that contains a rosin-type resin and is surface-modified by polyalkyleneimine, an insulating liquid comprising a liquid epoxy-modified compound, and a cationic photopolymerization initiator (Japanese Patent No. 5,277,800). However, there is a large amount of free polyalkyleneimine in the method disclosed in Japanese Patent No. 5,277,800, and this ends up reacting with the photopolymerization initiator. Due to this, inhibition of the polymerization of the polymerizable liquid monomer is prone to occur, and this makes it necessary to use very large amounts of the cationic photopolymerization initiator in order to obtain a satisfactory curability.

SUMMARY OF THE INVENTION

The present invention provides an ultraviolet-curable liquid developer that exhibits an excellent dispersion stability of a toner particle in a liquid developer and an excellent polymerizability of a polymerizable liquid monomer. The present invention also provides a method of producing this ultraviolet-curable liquid developer.

The present invention is an ultraviolet-curable liquid developer that contains a hydrophobic cationically polymerizable liquid monomer, a photopolymerization initiator, a toner particle insoluble in the liquid monomer, and a toner particle dispersing agent, wherein the toner particle contains a binder resin that has an acid value of at least 5 mg KOH/g, the toner particle dispersing agent is a polymer that contains at least both a monomer unit represented by general formula (1) below, and a monomer unit represented by general formula (2) below, and the toner particle dispersing agent has a monomer unit represented by general formula (1) at a position other than the terminal position.

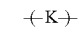

formula (1)

[In formula (1), K is a unit having a primary amino group.]

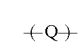

formula (2)

[In formula (2), Q is a unit having an alkyl group having at least 6 carbons, which may be substituted, a cycloalkyl group having at least 6 carbons, which may be substituted, an alkylene group having at least 6 carbons, which may be substituted, or a cycloalkylene group having at least 6 carbons, which may be substituted.].

The present invention is also a method of producing the aforementioned ultraviolet-curable liquid developer, this production method including: a step of obtaining a mixture by dissolving or dispersing at least a pigment, the binder resin having an acid value of at least 5 mg KOH/g, and the toner particle dispersing agent in a solvent that can dissolve the binder resin; and a step of precipitating the binder resin contained in the mixture in a dissolved state, by mixing the hydrophobic cationically polymerizable liquid monomer into the mixture.

The present invention can provide a liquid developer that exhibits an excellent dispersion stability of a toner particle in a liquid developer and an excellent polymerizability by the polymerizable liquid monomer. The present invention can also provide a method of producing this liquid developer.

Further features of the present invention will become apparent from the following description of exemplary embodiments (with reference to the attached drawings).

BRIEF DESCRIPTION OF THE DRAWINGS

FIG. 1 is a schematic diagram of a developing assembly used in the examples.

DESCRIPTION OF THE EMBODIMENTS

The present invention provides an ultraviolet-curable liquid developer that contains a hydrophobic cationically polymerizable liquid monomer, a photopolymerization initiator, a toner particle insoluble in the liquid monomer, and a toner particle dispersing agent, wherein the toner particle contains a binder resin that has an acid value of at least 5 mg KOH/g, the toner particle dispersing agent is a polymer that contains at least both a monomer unit represented by general formula (1) below and a monomer unit represented by general formula (2) below, and the toner particle dispersing agent has a monomer unit represented by general formula (1) at a position other than the terminal position.

$$\text{-}(K)\text{-} \qquad \text{formula (1)}$$

[In formula (1), K is a unit having a primary amino group.]

$$\text{-}(Q)\text{-} \qquad \text{formula (2)}$$

[In formula (2), Q is a unit having an alkyl group having at least 6 carbons, which may be substituted, a cycloalkyl group having at least 6 carbons, which may be substituted, an alkylene group having at least 6 carbons, which may be substituted, or a cycloalkylene group having at least 6 carbons, which may be substituted.].

Each of the materials is described in detail in the following.

< The Hydrophobic Cationically Polymerizable Liquid Monomer >

The hydrophobic cationically polymerizable liquid monomer will be described first.

The hydrophobic cationically polymerizable liquid monomer is a liquid monomer that has a low affinity for polar segments and that exhibits cationic polymerizability, and it is preferably a cationically polymerizable liquid monomer that has an SP value of at least 7.0 and not more than 9.0 and more preferably an SP value of at least 7.5 and not more than 8.5. This SP value is the solubility parameter. The SP value is a value introduced by Hildebrand and defined by a formal theory, and it is given by the square root of the cohesive energy density of the solvent (or solute) and is a measure of the solubility in a two-component system solution. In the present invention, the SP value is the value determined by calculation from the vaporization energy and molar volume of the atoms and atomic groups in accordance with Fedors as described in Coating Basics and Engineering (page 53, Yuji Harasaki, Converting Technical Institute). The unit for the SP value in the present invention is $(cal/cm^3)^{1/2}$, but this can be converted to the $(J/m^3)^{1/2}$ unit using 1 $(cal/cm^3)^{1/2}=2.046\times10^3\ (J/m^3)^{1/2}$.

The hydrophobic cationically polymerizable liquid monomer is preferably insulating. Specifically, its volume resistivity is preferably $1\times10^9$ to $1\times10^{13}$ Ωcm. In addition, its viscosity at 25° C. is preferably 0.5 to 200 mPa·s and is more preferably 0.5 to 30 mPa·s.

There are no particular limitations on the hydrophobic cationically polymerizable liquid monomer, and, for example, a vinyl ether compound, epoxy compound, or oxetane compound can be used; however, vinyl ether compounds are preferred from the standpoint of the polymerization rate.

A vinyl ether compound refers to a compound that has a vinyl ether structure (—CH═CH—O—C—).

This vinyl ether structure is preferably given by R—CH═CH—O—C—(R is hydrogen or $C_{1-3}$ alkyl and is preferably hydrogen or methyl).

The following are preferred here because they facilitate obtaining an ultraviolet-curable liquid composition that has a high resistance, a low viscosity, and a high sensitivity: dipropylene glycol divinyl ether, dicyclopentadiene vinyl ether, cyclohexanedimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether, 2,2-bis(4-hydroxycyclohexyl)propane divinyl ether, 1,2-decanediol divinyl ether, and the like. The incorporation of the following into the ultraviolet-curable liquid composition is preferred in order to improve the sensitivity and the post-cure strength: dicyclopentadiene vinyl ether, tricyclodecane vinyl ether, cyclohexanedimethanol divinyl ether, and 2,2-bis(4-hydroxycyclohexyl)propane divinyl ether.

For example, the vinyl ether compound represented by the following formula (A) is preferred.

$$(H_2C{=}CH{-}O\text{-})_n R \qquad \text{(A)}$$

[In formula (A), n represents the number of vinyl ether structures in one molecule and is an integer from 1 to 4. R is an n-valent hydrocarbon group.]

n is preferably an integer from 1 to 3.

R preferably is a group containing at least one group selected from $C_{1-20}$ linear-chain or branched, saturated or unsaturated aliphatic hydrocarbon groups, $C_{5-12}$ saturated or unsaturated alicyclic hydrocarbon groups, and $C_{6-14}$ aromatic hydrocarbon groups, and these alicyclic hydrocarbon groups and aromatic hydrocarbon groups may have a $C_{1-20}$ saturated or unsaturated aliphatic hydrocarbon group.

R is more preferably a $C_{4-18}$ linear-chain or branched saturated aliphatic hydrocarbon group or a $C_{5-12}$ saturated alicyclic hydrocarbon group possibly having a $C_{1-4}$ alkyl group.

A single hydrophobic cationically polymerizable liquid monomer may be used by itself or a combination of two or more may be used.

< The Photopolymerization Initiator >

The photopolymerization initiator is described in the following. The photopolymerization initiator in the present invention is a compound that reacts to light at a prescribed wavelength and thereby generates an acid. Such a compound can be exemplified by onium salt compounds, sulfone compounds, sulfonate ester compounds, sulfonimide compounds, and diazomethane compounds, but is not limited to the preceding. Among these compounds, the use of a sulfonate ester compound is preferred for the present invention.

The photopolymerization initiator represented by the following formula (6) is more preferably used in the present invention, and it provides little reduction in the volume resistivity of ultraviolet-curable liquids.

formula (6)

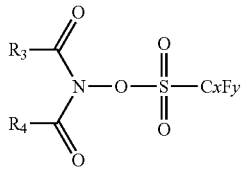

[In formula (6), $R_3$ and $R_4$ are bonded to each other to form a ring structure. x represents an integer from 1 to 8, and y represents an integer from 3 to 17.]

The ring structure here can be exemplified by 5-membered rings and 6-membered rings. Specific examples are succinimide structures, phthalimide structures, norbornene dicarboximide structures, naphthalene dicarboximide structures, cyclohexane dicarboximide structures, and epoxycyclohexene dicarboximide structures. These ring structures may also have, for example, the following as substituents: a $C_{1-4}$ alkyl group, $C_{1-4}$ alkyloxy group, $C_{1-4}$ alkylthio group, $C_{6-10}$ aryl group, $C_{6-10}$ aryloxy group, $C_{6-10}$ arylthio group, and so forth.

The $C_xF_y$ in general formula (6) can be exemplified by linear-chain alkyl groups in which the hydrogen atom has been substituted by the fluorine atom (RF1), branched-chain alkyl groups in which the hydrogen atom has been substituted by the fluorine atom (RF2), cycloalkyl groups in which the hydrogen atom has been substituted by the fluorine atom (RF3), and aryl groups in which the hydrogen atom has been substituted by the fluorine atom (RF4).

The linear-chain alkyl groups in which the hydrogen atom has been substituted by the fluorine atom (RF1) can be exemplified by the trifluoromethyl group (x=1, y=3), pentafluoroethyl group (x=2, y=5), heptafluoro-n-propyl group (x=3, y=7), nonafluoro-n-butyl group (x=4, y=9), perfluoro-n-hexyl group (x=6, y=13), and perfluoro-n-octyl group (x=8, y=17).

The branched-chain alkyl groups in which the hydrogen atom has been substituted by the fluorine atom (RF2) can be exemplified by the perfluoroisopropyl group (x=3, y=7), perfluoro-tert-butyl group (x=4, y=9), and perfluoro-2-ethylhexyl group (x=8, y=17).

The cycloalkyl groups in which the hydrogen atom has been substituted by the fluorine atom (RF3) can be exemplified by the perfluorocyclobutyl group (x=4, y=7), perfluorocyclopentyl group (x=5, y=9), perfluorocyclohexyl group (x=6, y=11), and perfluoro(1-cyclohexyl)methyl group (x=7, y=13).

The aryl groups in which the hydrogen atom has been substituted by the fluorine atom (RF4) can be exemplified by the pentafluorophenyl group (x=6, y=5) and 3-trifluoromethyltetrafluorophenyl group (x=7, y=7).

For the $C_xF_y$ in general formula (6), the linear-chain alkyl groups (RF1), branched-chain alkyl groups (RF2), and aryl groups (RF4) are preferred from the standpoint of the ease of acquisition and the decomposability of the sulfonate ester moiety, while the linear-chain alkyl groups (RF1) and aryl groups (RF4) are more preferred and the trifluoromethyl group (x=1, y=3), pentafluoroethyl group (x=2, y=5), heptafluoro-n-propyl group (x=3, y=7), nonafluoro-n-butyl group (x=4, y=9), and pentafluorophenyl group (x=6, y=5) are particularly preferred.

A single photopolymerization initiator can be used or a combination of two or more photopolymerization initiators can be used. The content of the photopolymerization initiator in the ultraviolet-curable liquid developer composition of the present invention is not particularly limited, but, expressed per 100 mass parts of the liquid monomer, is preferably 0.01 to 5 mass parts, more preferably 0.05 to 1 mass parts, and even more preferably 0.1 to 0.5 mass parts.

<The Toner Particle>

The toner particle is described in the following. The toner particle contains a binder resin and a pigment as constituent components.

<Binder Resin>

The toner particle contains a resin having an acid value of at least 5 mg KOH/g as a binder. When the acid value is lower than 5 mg KOH/g, bonding with the amine value possessed by the toner particle dispersing agent cannot adequately form and the dispersion stability of the toner particle is reduced. This acid value is preferably at least 5 mg KOH/g and not more than 100 mg KOH/g and is more preferably at least 5 mg KOH/g and not more than 50 mg KOH/g. In the case, for example, of a vinyl resin, the acid value of the resin can be controlled through the molar ratio in the total monomer of the acrylic acid and methacrylic acid in the resin, and in the case, for example, of a polyester, the acid value of the resin can be controlled through the number of terminal groups and the number of carboxylic acid groups in the terminal group population.

There are no particular limitations on the type of binder resin having an acid value of at least 5 mg KOH/g that is incorporated in the toner particle, and it can be exemplified by vinyl resins, polyester resins, polyurethane resins, epoxy resins, polyamide resins, polyimide resins, silicon resins, phenolic resins, melamine resins, urea resins, aniline resins, ionomer resins, polycarbonate resins, and so forth. Two or more of these resins may be used in combination.

Viewed from the standpoint of facilitating the realization of the present embodiments, at least one of vinyl resins, polyester resins, polyurethane resins, and epoxy resins is preferably used as the binder resin having an acid value of at least 5 mg KOH/g that is incorporated in the toner particle, and the use of at least one of polyester resins and vinyl resins is more preferred.

The SP value of the binder resin according to the present invention is preferably at least 9.0 and not more than 15.0 and is more preferably at least 9.5 and not more than 13.0.

The polyester resin is preferably a polyester resin that uses a diol and a dicarboxylic acid as monomers.

The diol can be exemplified by ethylene glycol, propylene glycol, neopentyl glycol, and ethylene oxide adducts and/or propylene oxide adducts on bisphenol A.

The dicarboxylic acid can be exemplified by terephthalic acid, isophthalic acid, ortho-phthalic acid, and fumaric acid.

The monomer used for the vinyl resin can be exemplified by styrene, (meth)acrylic acid, methyl (meth)acrylate, and butyl (meth)acrylate.

The toner particle concentration in the ultraviolet-curable liquid developer in the present invention is preferably at least 1 mass % and not more than 70 mass %.

From the standpoint of obtaining a high-definition image, the volume-based average particle diameter of this toner particle is preferably at least 0.05 μm and not more than 5 μm and is more preferably at least 0.05 μm and not more than 1

<Pigment>

The toner particle contains a pigment in addition to the resin incorporated as a binder.

The following are specific examples of organic pigments and inorganic pigments that present a yellow color and can be used in the present invention: C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185, and C. I. Vat Yellow 1, 3, and 20.

Pigments that present a red or magenta color can be exemplified by the following: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, and 269; C. I. Pigment Violet 19; and C. I. Vat Red 1, 2, 10, 13, 15, 23, 29, and 35.

Pigments that present a blue or cyan color can be exemplified by the following: C. I. Pigment Blue 2, 3, 15:2, 15:3, 15:4, 16, and 17; C. I. Vat Blue 6; C. I. Acid Blue 45; and copper phthalocyanine pigments in which the phthalocyanine skeleton is substituted by 1 to 5 phthalimidomethyl groups.

Pigments that present a green color can be exemplified by the following: C. I. Pigment Green 7, 8, and 36.

Pigments that present an orange color can be exemplified by the following: C. I. Pigment Orange 66 and 51.

Pigments that present a black color can be exemplified by the following: carbon black, titanium black, and aniline black.

White pigments can be specifically exemplified by the following: basic lead carbonate, zinc oxide, titanium oxide, and strontium titanate.

Here, titanium oxide has a smaller specific gravity and a higher refractive index and is also more chemically and physically stable than the other white pigments and therefore has a high hiding power and tinting strength as a pigment and in addition has an excellent durability versus acid and alkali and other environments. The use of titanium oxide for the white pigment is therefore preferred. Other white pigments (including white pigments other than those provided as examples) may of course also be used as necessary.

For example, a ball mill, sand mill, attritor, roll mill, jet mill, homogenizer, paint shaker, kneader, agitator, Henschel mixer, colloid mill, ultrasonic homogenizer, pearl mill, wet jet mill, and so forth can be used as the dispersing apparatus for dispersing the pigment.

A pigment dispersing agent may also be added when pigment dispersion is carried out. The pigment dispersing agent can be exemplified by hydroxyl group-bearing carboxylate esters, the salts of long-chain polyaminoamides and high molecular weight acid esters, the salts of high molecular weight polycarboxylic acids, high molecular weight unsaturated acid esters, high molecular weight copolymers, modified polyacrylates, aliphatic polybasic carboxylic acids, naphthalenesulfonic acid/formalin condensates, polyoxyethylene alkyl phosphate esters, and pigment derivatives. The use of commercially available pigment dispersing agents such as the Solsperse series from The Lubrizol Corporation is also preferred.

A synergist adapted to the particular pigment may also be used as a pigment dispersing aid. These pigment dispersing agents and pigment dispersing aids are added preferably at 1 to 100 mass parts per 100 mass parts of the pigment.

The amount of addition of the pigment, expressed per 100 mass parts of the binder resin, is preferably 1 to 100 mass parts and more preferably 5 to 50 mass parts.

<Charge Adjuvant>

The toner particle may contain a charge adjuvant with the goal of adjusting the charging performance of the toner particle. A known charge adjuvant can be used.

Examples of specific compounds are as follows: metal soaps such as zirconium naphthenate, cobalt naphthenate, nickel naphthenate, iron naphthenate, zinc naphthenate, cobalt octanoate, nickel octanoate, zinc octanoate, cobalt dodecanoate, nickel dodecanoate, zinc dodecanoate, aluminum stearate, aluminum tristearate, and cobalt 2-ethylhexanoate; metal sulfonates such as petroleum-based metal sulfonates and the metal salts of sulfosuccinate esters; phospholipids such as lecithin; metal salicylates such as metal t-butyl salicylate complexes; polyvinylpyrrolidone resins; polyamide resins; sulfonic acid-containing resins; and hydroxybenzoic acid derivatives.

<The Toner Particle Dispersing Agent>

The toner particle dispersing agent in the present invention characteristically is a polymer that contains at least both a monomer unit represented by general formula (1) below and a monomer unit represented by general formula (2) below and has a monomer unit represented by general formula (1) at a position other than the terminal position.

$$\text{-}(K)\text{-} \qquad \text{formula (1)}$$

[In formula (1), K is a unit having a primary amino group.]

$$\text{-}(Q)\text{-} \qquad \text{formula (2)}$$

[In formula (2), Q is a unit having an alkyl group having at least 6 carbons, which may be substituted, a cycloalkyl group having at least 6 carbons, which may be substituted, an alkylene group having at least 6 carbons, which may be substituted, or a cycloalkylene group having at least 6 carbons, which may be substituted.]

The toner particle dispersing agent in the present invention has a monomer unit with general formula (1) at a position other than the terminal position in the molecule. Thus, a polymer that has a primary amino group only at the terminal position in the molecular chain is excluded. A monomer unit with formula (1) may be present in terminal position as long as a monomer unit with formula (1) is present in a position other than the terminal position of the molecule.

The molecular weight of the toner particle dispersing agent depends on the number of monomer units with general formula (1) and monomer units with general formula (2) constituting the toner particle dispersing agent, and a number-average molecular weight of 1,000 to 40,000 is preferred. An excellent dispersion stability by the toner particle is obtained by having the number-average molecular weight be in the indicated range.

Using 1 for the number of monomer units with general formula (1) present in the toner particle dispersing agent, the number of monomer units with general formula (2) present in the toner particle dispersing agent is then preferably 0.01 to 100 on average and is more preferably 0.1 to 10 on average. A satisfactory affinity for the hydrophobic cationically polymerizable liquid monomer appears on when the number of monomer units with formula (2) is at least 0.01, while an excellent dispersion stability by the toner particle is displayed at not more than 100.

The amine value of the toner particle dispersing agent depends on the number of monomer units with general formula (1) and monomer units with general formula (2) constituting the toner particle dispersing agent, and the toner particle dispersion stability, the fixing performance, and the developing performance are particularly good when the amine value is at least 2 mg KOH/g and not more than 50 mg KOH/g. The reason for this is not clear, but the present inventors hypothesize as follows. It is thought that the amino group of the toner particle dispersing agent exhibits a toner particle-dispersing effect through ionic bonding with the acid group in the binder resin, and that ionic bonding with the acid group in the binder resin is inadequate when the amine value of the toner particle dispersing agent is less than 2 mg KOH/g. When, on the other hand, the amine value is greater than 50 mg KOH/g, it is thought that a large amount of the amino group is not involved in bonding with the acid group in the binder resin and can then readily cause inhibition of the cure of the hydrophobic cationically polymerizable liquid monomer. This amine value is more preferably at least 5 mg KOH/g and not more than 30 mg KOH/g.

This amine value can be controlled using the ratio in the toner particle dispersing agent between the monomer unit with general formula (1) and the monomer unit with general formula (2).

The amount of addition of the toner particle dispersing agent relative to the toner particle is preferably 1 to 100 mass parts per 100 mass parts of the toner particle.

The toner particle dispersing agent in the present invention is a polymer that contains both the monomer unit with general formula (1) and the monomer unit with general formula (2), and it may be a polymer that contains a monomer unit other than these.

The monomer unit with general formula (1) is preferably at least 1 mass % and not more than 70 mass % of the total monomer unit in the toner particle dispersing agent. In addition, the monomer unit with general formula (2) is preferably at least 30 mass % and not more than 99 mass % of the total monomer unit in the toner particle dispersing agent.

<The Monomer Unit with General Formula (1) >

The monomer unit represented by general formula (1) is described in detail in the following.

The primary amino group possessed by the K in general formula (1) denotes a group given by —$NH_2$. As a result of intensive investigations carried out by the present inventors, it was discovered that the primary amino group has a substantially higher toner particle-dispersing effect than the secondary amino group and the tertiary amino group. While the reason for this is unclear, the present inventors hypothesize that this is due to the following. It is thought that the amino group of the toner particle dispersing agent exhibits a toner particle-dispersing effect through ionic bonding with the acid group in the binder resin, and that the steric hindrance when a primary amino group forms an ionic bond with the acid group is less than for a secondary amino group and a tertiary amino group.

The structure of the unit that contains the primary amino group is not particularly limited, but the monomer unit with general formula (1) is preferably represented by the following general formula (1-2) from the standpoint of the toner particle dispersion stability in the present invention.

formula (1-2)

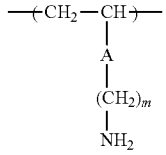

(In the formula, A is a single bond, $C_{1-6}$ (preferably $C_{1-3}$) alkylene, or phenylene. m is an integer from 0 to 3.)

In addition, the monomer unit with general formula (1) is more preferably represented by the following general formula (3).

formula (3)

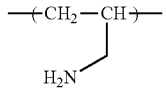

<The Monomer Unit with General Formula (2)>

The monomer unit represented by general formula (2) is described in detail in the following.

The alkyl group having at least 6 carbons, which may be substituted, or the cycloalkyl group having at least 6 carbons, which may be substituted, possessed by Q in general formula (2) denotes an alkyl group given by the linear-chain —$C_nH_{2n+1}$ wherein the number of carbons n is at least 6, or a cycloalkyl group given by the cyclic —$C_nH_{2n-1}$ wherein the number of carbons n is at least 6. Here, the number of carbons n is more preferably at least 12 from the standpoint of the affinity for the hydrophobic cationically polymerizable liquid monomer. The upper limit on the number of carbons n is preferably equal to or less than 30 and is more preferably equal to or less than 22. In addition, at least one hydrogen atom on this alkyl group or cycloalkyl group may be substituted.

There are no particular limitations on the substituent that may be present on the alkyl group or cycloalkyl group possessed by Q, and the substituent can be exemplified by the alkyl group, alkoxy group, halogen atom, amino group, hydroxyl group, carboxyl group, carboxylate ester group, carboxamide group, and so forth.

Viewed from the perspective of the affinity for the hydrophobic cationically polymerizable liquid monomer and the ease of production, the monomer unit with general formula (2) is preferably represented by the following general formula (4).

formula (4)

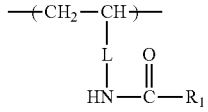

[In formula (4), $R_1$ is an alkyl group having at least 6 carbons, which may be substituted, or a cycloalkyl group having at least 6 carbons, which may be substituted. L represents a divalent linking group.]

$R_1$ denotes an alkyl group given by the linear-chain —$C_nH_{2n+1}$ wherein n is at least 6, or a cycloalkyl group given by the cyclic —$C_nH_{2n-1}$ wherein n is at least 6. n is more preferably at least 12. The upper limit on n, on the other hand, is preferably equal to or less than 30 and is more preferably equal to or less than 22.

There are no particular limitations on the substituent that may be present on $R_1$, and the substituent can be exemplified by the alkyl group, alkoxy group, halogen atom, amino group, hydroxyl group, carboxyl group, carboxylate ester group, carboxamide group, and so forth.

L represents a divalent linking group and is preferably an alkylene group (having, for example, 1 to 6 and preferably 1 to 3 carbons), an alkenylene group (having, for example, 1 to 6 and preferably 1 to 3 carbons), or an arylene group (having, for example, 6 to 10 carbons).

The alkylene group having at least 6 carbons, which may be substituted, or the cycloalkylene group having at least 6 carbons, which may be substituted, possessed by Q in general formula (2) denotes an alkylene group given by the linear-chain $—C_nH_{2n}—$ wherein the number of carbons n is at least 6, or a cycloalkylene group given by the cyclic $—C_nH_{2n-2}—$ wherein the number of carbons n is at least 6. Here, the number of carbons n is more preferably at least 12 from the standpoint of the affinity for the hydrophobic cationically polymerizable liquid monomer. The upper limit on the number of carbons n, on the other hand, is preferably equal to or less than 30 and is more preferably equal to or less than 22. In addition, at least one hydrogen atom on the alkylene group or cycloalkylene group may be substituted.

There are no particular limitations on the substituent that may be present on the alkylene group or cycloalkylene group possessed by Q, and the substituent can be exemplified by the alkyl group, alkoxy group, halogen atom, amino group, hydroxyl group, carboxyl group, carboxylate ester group, carboxamide group, and so forth.

Viewed from the perspective of the affinity for the hydrophobic cationically polymerizable liquid monomer and the ease of production, the monomer unit with general formula (2) is preferably represented by the following general formula (5).

formula (5)

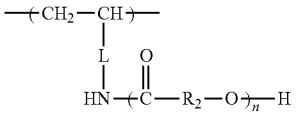

[In formula (5), $R_2$ is an alkylene group having at least 6 carbons, which may be substituted, or a cycloalkylene group having at least 6 carbons, which may be substituted. n represents an integer equal to or greater than 1 (preferably at least 2 and not more than 20). L represents a divalent linking group.]

$R_2$ denotes an alkylene group given by the linear-chain $—C_nH_{2n}—$ wherein the number of carbons n is at least 6, or a cycloalkylene group given by the cyclic $—C_nH_{2n-2}—$ wherein the number of carbons n is at least 6. The number of carbons n is more preferably at least 12. The upper limit on the number of carbons n, on the other hand, is preferably equal to or less than 30 and is more preferably equal to or less than 22.

There are no particular limitations on the substituent that may be present on $R_2$, and the substituent can be exemplified by the alkyl group, alkoxy group, halogen atom, amino group, hydroxyl group, carboxyl group, carboxylate ester group, carboxamide group, and so forth.

In addition, preferred examples of L are the same as for formula (4).

<Other Additives>

The ultraviolet-curable liquid developer of the present invention may as necessary contain, for example, the following additives.

<Sensitizer>

A sensitizer may as necessary be added to the ultraviolet-curable liquid developer of the present invention with the goals of, for example, improving the acid-generating efficiency of the photopolymerization initiator and extending the photosensitive wavelengths to longer wavelengths. Any sensitizer may be used that is capable of sensitizing the photopolymerization initiator through an electron transfer mechanism or energy transfer mechanism. Preferred examples include aromatic polycondensed ring compounds such as anthracene, 9,10-dialkoxyanthracene, pyrene, and perylene; aromatic ketone compounds such as acetophenone, benzophenone, thioxanthone, and Michler's ketone; and heterocyclic compounds such as phenothiazine and N-aryloxazolidinone. The amount of addition is selected as appropriate in correspondence to the goal, and is generally preferably 0.1 to 10 mass parts and more preferably 1 to 5 mass parts per 1 mass parts of the photopolymerization initiator.

A co-sensitizer may also be added to the ultraviolet-curable liquid developer of the present invention with the goal of improving the electron transfer efficiency or energy transfer efficiency between the aforementioned sensitizer and the photopolymerization initiator.

The co-sensitizer can be specifically exemplified by the following: naphthalene compounds such as 1,4-dihydroxynaphthalene, 1,4-dimethoxynaphthalene, 1,4-diethoxynaphthalene, 4-methoxy-1-naphthol, and 4-ethoxy-1-naphthol, and benzene compounds such as 1,4-dihydroxybenzene, 1,4-dimethoxybenzene, 1,4-diethoxybenzene, 1-methoxy-4-phenol, and 1-ethoxy-4-phenol.

The amount of co-sensitizer addition is selected as appropriate in correspondence to the goal, but is preferably 0.1 to 10 mass parts and more preferably 0.5 to 5 mass parts per 1 mass parts of the sensitizer.

<Cationic Polymerization Inhibitor>

A cationic polymerization inhibitor can also be added to the ultraviolet-curable liquid developer of the present invention. The cationic polymerization inhibitor can be exemplified by alkali metal compounds and/or alkaline-earth metal compounds and by amines.

Preferred examples of the amine include alkanolamines, N,N-dimethylalkylamines, N,N-dimethylalkenylamines, and N,N-dimethylalkynylamines. The amines can be specifically exemplified by triethanolamine, triisopropanolamine, tributanolamine, N-ethyldiethanolamine, propanolamine, n-butylamine, sec-butylamine, 2-aminoethanol, 2-methylaminoethanol, 3-methylamino-1-propanol, 3-methylamino-1,2-propanediol, 2-ethylaminoethanol, 4-ethylamino-1-butanol, 4-(n-butylamino)-1-butanol, 2-(t-butylamino)ethanol, N,N-dimethylundecanolamine, N,N-dimethyldodecanolamine, N,N-dimethyltridecanolamine, N,N-dimethyltetradecanolamine, N,N-dimethylpentadecanolamine, N,N-dimethylnonadecylamine, N,N-dimethylicosylamine, N,N-dimethyleicosylamine, N,N-dimethylheneicosylamine, N,N-dimethyldocosylamine, N,N-dimethyltricosylamine, N,N-dimethyltetracosylamine, N,N-dimethylpentacosylamine, N,N-dimethylpentanolamine, N,N-dimethylhexanolamine, N,N-dimethylheptanolamine, N,N-dimethyloctanolamine, N,N-dimethylnonanolamine, N,N-dimethyldecanolamine, N,N-dimethylnonylamine, N,N-dimethyldecylamine, N,N-dimethylundecylamine, N,N-dimethyldodecylamine, N,N-dimethyltridecylamine, N,N-dimethyltetradecylamine, N,N-dimethylpentadecylamine, N,N-dimethylhexadecylamine, N,N-dimethylheptadecylamine, and N,N-dimethyloctadecylamine. In addition to these, for example, a quaternary ammonium salt may also be used. The cationic polymerization inhibitor is particularly preferably a secondary amine.

The amount of addition of the cationic polymerization inhibitor is preferably 1 to 5,000 ppm on a mass basis with reference to the ultraviolet-curable liquid developer of the present invention.

<Radical Polymerization Inhibitor>

A radical polymerization inhibitor may be added to the ultraviolet-curable liquid developer of the present invention.

In the case of an ultraviolet-curable liquid developer that contains a vinyl ether compound, during storage the photopolymerization initiator may undergo a trace decomposition and thereby convert into a radical compound and a polymerization caused by this radical compound may then be induced. A radical polymerization inhibitor is preferably added to prevent this.

Usable radical polymerization inhibitors can be exemplified by phenolic hydroxyl group-containing compounds; quinones such as methoquinone (hydroquinone monomethyl ether), hydroquinone, and 4-methoxy-1-naphthol; hindered amine antioxidants; 1,1-diphenyl-2-picrylhydrazyl free radical; N-oxyl free radical compounds; nitrogen-containing heterocyclic mercapto compounds; thioether antioxidants; hindered phenol antioxidants; ascorbic acids; zinc sulfate; thiocyanates; thiourea derivatives; saccharides; phosphoric acid-type antioxidants; nitrites; sulfites; thiosulfates; hydroxylamine derivatives; aromatic amines; phenylenediamines; imines; sulfonamides; urea derivatives; oximes; polycondensates of dicyandiamide and polyalkylenepolyamine; sulfur-containing compounds such as phenothiazine; complexing agents based on tetraazaannulene (TAA); and hindered amines.

Phenolic hydroxyl group-containing compounds, N-oxyl free radical compounds, 1,1-diphenyl-2-picrylhydrazyl free radical, phenothiazine, quinones, and hindered amines are preferred from the standpoint of preventing the ultraviolet-curable liquid developer from undergoing a viscosity increase due to the polymerization of the vinyl ether compound, while N-oxyl free radical compounds are particularly preferred.

The amount of addition of the radical polymerization inhibitor is preferably 1 to 5,000 ppm on a mass basis relative to the ultraviolet-curable liquid developer of the present invention.

<Charge Control Agent>

The ultraviolet-curable liquid developer of the present invention may as necessary contain a charge control agent. A known charge control agent can be used. Examples of specific compounds are as follows: fats and oils such as linseed oil and soy oil; alkyd resins; halogen polymers; aromatic polycarboxylic acids; acidic group-containing water-soluble dyes; oxidative condensates of aromatic polyamines; metal soaps such as cobalt naphthenate, nickel naphthenate, iron naphthenate, zinc naphthenate, cobalt octanoate, nickel octanoate, zinc octanoate, cobalt dodecanoate, nickel dodecanoate, zinc dodecanoate, aluminum stearate, and cobalt 2-ethylhexanoate; metal sulfonates such as petroleum-based metal sulfonates and metal salts of sulfosuccinate esters; phospholipids such as lecithin; metal salicylates such as metal t-butylsalicylate complexes; polyvinylpyrrolidone resins; polyamide resins; sulfonic acid-containing resins; and hydroxybenzoic acid derivatives.

In addition to those described above, various known additives, e.g., surfactant, lubricant, filler, antifoaming agent, ultraviolet absorber, antioxidant, anti-fading agent, fungicide, anticorrosion agent, and so forth, can as necessary be selected as appropriate and used in the ultraviolet-curable liquid developer of the present invention with the goal of improving the compatibility with recording media, the storage stability, the image storability, and other characteristics.

<Method of Producing the Ultraviolet-Curable Liquid Developer>

There are no particular limitations on the method of producing the ultraviolet-curable liquid developer of the present invention. The method of producing the toner particle used in the ultraviolet-curable liquid developer of the present invention can be exemplified by known methods such as the coacervation method, wet pulverization method, miniemulsion polymerization method, and so forth. The coacervation method is preferred for the present invention from standpoint of the particle diameter and dispersion stability.

Thus, a preferred method includes a step of obtaining a mixture, in which at least a pigment, the binder resin having an acid value of at least 5 mg KOH/g, and the toner particle dispersing agent and optionally additives, e.g., a pigment dispersing agent and so forth, are dissolved or dispersed in a solvent capable of dissolving the binder resin; and a step of mixing, into the mixture, a hydrophobic cationically polymerizable liquid monomer that does not dissolve the binder resin, in order to cause the binder resin present in a dissolved state in the mixture to precipitate with the pigment enclosed therein. The ultraviolet-curable liquid developer can be obtained by adding, to the toner particle dispersion obtained by the precipitation of the binder resin, the photopolymerization initiator and as necessary additives such as a charge control agent and so forth.

In the coacervation method, a non-pigment material (binder resin) surrounding a pigment can be precipitated to enclose the pigment by mixing a hydrophobic cationically polymerizable liquid monomer that is a poor solvent for the binder resin, into a mixture in which the non-pigment material (binder resin) is dissolved.

There are no particular limitations on the solvent here as long as it is a solvent that dissolves the binder resin. It can be exemplified by ethers such as tetrahydrofuran, ketones such as methyl ethyl ketone and cyclohexanone, esters such as ethyl acetate, and halides such chloroform. It may be an aromatic hydrocarbon, such as toluene, benzene, and so forth, insofar as it has the ability to dissolve the resin. With regard to the determination in the present invention of whether a solvent "dissolves the binder resin", the determination of "does not dissolve" is made when not more than 1 mass parts of the resin dissolves (25° C.) in 100 mass parts of the solvent or hydrophobic cationically polymerizable liquid monomer.

The SP value of the solvent is preferably at least 8.7 and not more than 13.8 and more preferably at least 8.8 and not more than 12.5.

EXAMPLES

The present invention is more specifically described by the examples given below, but the present invention is not limited to or by these. Unless specifically indicated otherwise, "parts" and "%" indicate, respectively, "mass parts" and "mass %" in the description that follows.

[Measurement Methods]

The measurement methods used in these synthesis examples are given in the following.

(1) Measurement of the Molecular Weight (Weight-Average Molecular Weight (Mw) and Number-Average Molecular Weight)

The molecular weight of resin is determined as polystyrene using gel permeation chromatography (GPC). The measurement of the molecular weight by GPC was carried out as follows.

A solution was prepared by adding the sample to the eluent indicated below to provide a sample concentration of 1.0 mass % and standing for 24 hours at room temperature. This solution was filtered across a solvent-resistant membrane filter with a pore diameter of 0.2 μm to obtain the sample solution, and measurement was performed under the following conditions.

instrument: "HLC-8220GPC" high-performance GPC instrument (from the Tosoh Corporation)

column: 2×LF-804 eluent: THF flow rate: 1.0 mL/minute oven temperature: 40° C.

sample injection amount: 0.025 mL

The molecular weight calibration curve used to determine the molecular weight of the sample was constructed using polystyrene resin standards [TSK Standard Polystyrene F-850, F-450, F-288, F-128, F-80, F-40, F-20, F-10, F-4, F-2, F-1, A-5000, A-2500, A-1000, and A-500, from the Tosoh Corporation].

(2) Measurement of the Acid Value

The acid value of the binder resins involved in the execution of the present invention is determined using the following method.

The basic procedure is based on JIS K 0070.

1) Weigh out exactly 0.5 to 2.0 g of the sample. This mass is designated M (g).

2) Place the sample in a 50-mL beaker and add 25 mL of a tetrahydrofuran/ethanol (2/1) mixture and dissolve.

3) Perform titration using an ethanol solution of 0.1 mol/L KOH and using a potentiometric titrator [for example, a "COM-2500" automatic titrator from Hiranuma Sangyo Co., Ltd. can be used].

4) The amount of the KOH solution used at this time is designated S (mL). The blank is measured at the same time, and the amount of KOH used for this is designated B (mL).

5) The acid value is calculated using the following formula. f is the factor for the KOH Solution.

$$\text{acid value[mg KOH/g]} = \frac{(S-B)\times f\times 5.61}{M}$$

(3) Measurement of the Amine Value

The amine value of the toner particle dispersing agents involved in the execution of the present invention is determined using the following method.

The basic procedure is based on ASTM D 2074.

1) Weigh out exactly 0.5 to 2.0 g of the sample. This mass is designated M (g).

2) Place the sample in a 50-mL beaker and add 25 mL of a tetrahydrofuran/ethanol (3/1) mixture and dissolve.

3) Perform titration using an ethanol solution of 0.1 mol/L HCl and using a potentiometric titrator [for example, a "COM-2500" automatic titrator from Hiranuma Sangyo Co., Ltd. can be used].

4) The amount of the HCl solution used at this time is designated S (mL). The blank is measured at the same time, and the amount of HCl used for this is designated B (mL).

5) The amine value is calculated using the following formula. f is the factor for the HCl solution.

$$\text{amine value[mg KOH/g]} = \frac{(S-B)\times f\times 5.61}{M}$$

<Measurement of the Acid Value of the Binder Resin Incorporated in the Toner Particle, from the Ultraviolet-Curable Liquid Developer>

The acid value of the binder resin incorporated in the toner particle in the ultraviolet-curable liquid developer is determined by the following method.

1) Carry out centrifugal separation on approximately 10 g of the ultraviolet-curable liquid developer to sediment the toner particles; discard the supernatant.

2) Add hexane to the toner particles; stir well; centrifugally separate and sediment the toner particles; discard the supernatant. Perform this 3 times and then dry thoroughly.

3) To the result from 2), add 10 g of tetrahydrofuran and 5 g of an ethanol solution of 1 mol/L HCl and allow to stand overnight. Stir the result well and then perform centrifugal separation to remove the tetrahydrofuran-insoluble component. Thoroughly dry the tetrahydrofuran-soluble component (mixture of the binder resin and the hydrochloride of the toner dispersing agent) in the supernatant.

4) Add a small amount of tetrahydrofuran to the tetrahydrofuran-soluble component obtained in 3) to cause swelling; then to this add a large amount of hexane and stir well; subsequently carry out centrifugal separation and sediment the binder resin and discard the supernatant. Perform this 3 times and then dry thoroughly.

5) Measure the acid value by the method described above using the hexane-insoluble component obtained in 4).

Example 1

Binder Resin Production Examples

[Binder Resin (P-1) Production Example]

A binder resin (P-1) having the following structure was produced by the production method described below. The "x/y" and "x/y/z" in the following formulas indicate the mass ratio.

(P-1)

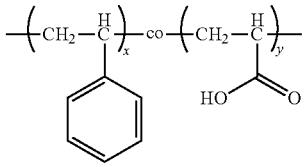

x/y = 4/1

First, 100 parts of propylene glycol monomethyl ether was heated under reflux at a temperature of at least 120° C. while carrying out nitrogen replacement, and to this was added dropwise over 3 hours a mixture of 160 parts of styrene, 40 parts of acrylic acid, and 1.0 parts of tert-butyl peroxybenzoate [organoperoxide polymerization initiator, product name: Perbutyl Z, NOF Corporation]. After the completion of the dropwise addition, the solution was stirred for 3 hours followed by distillation at normal pressure while raising the solution temperature to 170° C. Once the solution temperature reached 170° C., distillation was carried out for 1 hour at a reduced pressure of 1 hPa to remove the solvent and obtain (P-1).

The analytical results for this product are as follows.

[Analytical Results for Binder Resin (P-1)]

GPC result: weight-average molecular weight (Mw)=19,930 result of the acid value measurement: 112 mg KOH/g

[Binder Resin (P-2) Production Example]

A binder resin (P-2) having the structure indicated below was obtained using the same method as in the Binder Resin (P-1) Production Example, but using 168 parts of methyl methacrylate and 14 parts of methacrylic acid for the 160 parts of styrene and 40 parts of acrylic acid used in the Binder Resin (P-1) Production Example.

(P-2)

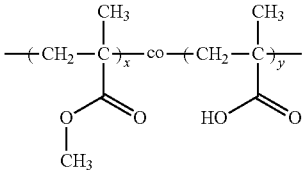

x/y = 12/1

The analytical results for this product are as follows.

[Analytical Results for Binder Resin (P-2)]

GPC result: weight-average molecular weight (Mw)=19,730 result of the acid value measurement: 43 mg KOH/g

Example 2

Toner Particle Dispersing Agent Production Examples

[Dispersing Agents (D-1) to (D-5) Production Example]

Dispersing agents (D-1) to (D-5) with the structures given below were produced by the same method as in the Binder Resin (P-1) Production Example, but changing the 160 parts of styrene and the 40 parts of acrylic acid used in the Binder Resin (P-1) Production Example to the monomers corresponding to the desired dispersing agent.

(D-1)

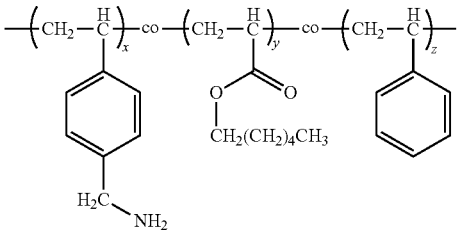

x/y/z = 30/60/10

-continued (D-2)

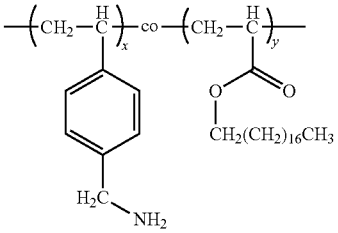

x/y = 40/60

(D-3)

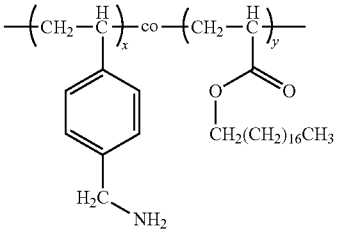

x/y = 10/90

(D-4)

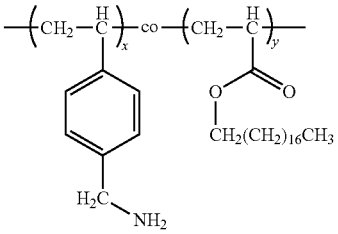

x/y = 3/97

(D-5)

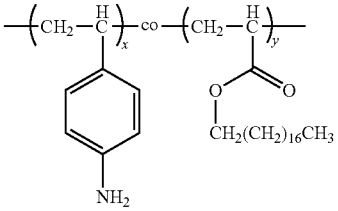

x/y = 10/90

The analytical results for the obtained products are as follows.

[Analytical Results for Dispersing Agent (D-1)]

GPC result: weight-average molecular weight (Mw)=12,000 result of the amine value measurement: 110 mg KOH/g

[Analytical Results for Dispersing Agent (D-2)]

GPC result: weight-average molecular weight (Mw)=12,120 result of the amine value measurement: 105 mg KOH/g

[Analytical Results for Dispersing Agent (D-3)]

GPC result: weight-average molecular weight (Mw)=11,150 result of the amine value measurement: 25 mg KOH/g

[Analytical Results for Dispersing Agent (D-4)]

GPC result: weight-average molecular weight (Mw)=10,050 result of the amine value measurement: 11 mg KOH/g

[Analytical Results for Dispersing Agent (D-5)]

GPC result: weight-average molecular weight (Mw)=12,600 result of the amine value measurement: 28 mg KOH/g

[Dispersing Agent (D-6) Production Example]

Dispersing agent (D-6) having the following structure was produced by the production method described below.

(D-6)

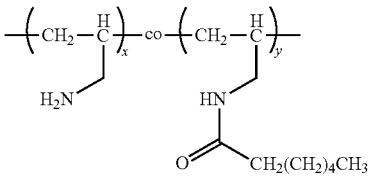

x/y = 3/97

8 parts of xylene and 10 parts of a 10% aqueous polyallylamine solution ("PAA-01", Nitto Boseki Co., Ltd., number-average molecular weight=approximately 1,600) were added to a flask equipped with a Dean-Stark trap and were stirred at 160° C. while distilling out water. To this were added 12 parts of heptanoic acid and 50 parts of xylene that had been heated to 160° C. and a reaction was run for 2 hours at 160° C.

The analytical results for the obtained product are as follows.

[Analytical Results for Dispersing Agent (D-6)]

result of the amine value measurement: 28 mg KOH/g

[Dispersing Agents (D-7) to (D-11) Production Example]

Dispersing agents (D-7) to (D-11) with the structures given below were produced by the same method as in the Dispersing Agent (D-6) Production Example, but changing the 12 parts of heptanoic acid used in the Dispersing Agent (D-6) Production Example to the fatty acid corresponding to the desired dispersing agent.

(D-7)

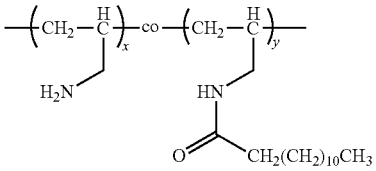

x/y = 3/97

(D-8)

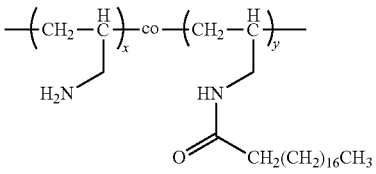

x/y = 3/97

(D-9)

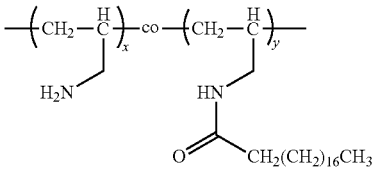

x/y = 1/99

-continued (D-10)

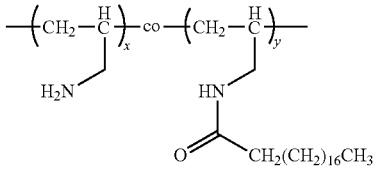

x/y = 15/85

(D-11)

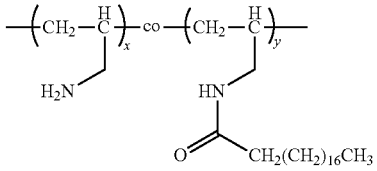

x/y = 25/75

The analytical results for the obtained products are as follows.

[Analytical Results for Dispersing Agent (D-7)]

result of the amine value measurement: 10 mg KOH/g

[Analytical Results for Dispersing Agent (D-8)]

result of the amine value measurement: 5 mg KOH/g

[Analytical Results for Dispersing Agent (D-9)]

result of the amine value measurement: 3 mg KOH/g

[Analytical Results for Dispersing Agent (D-10)]

result of the amine value measurement: 40 mg KOH/g

[Analytical Results for Dispersing Agent (D-11)]

result of the amine value measurement: 62 mg KOH/g

Comparative Example 1

Comparative Dispersing Agent Production Example

[Comparative Dispersing Agent (D-101) Production Example]

Comparative dispersing agent (D-101) with the structure indicated below was produced by the same method as in the Dispersing Agent (D-6) Production Example, but changing the 12 parts of heptanoic acid used in the Dispersing Agent (D-6) Production Example to 10 parts of valeric acid.

(D-101)

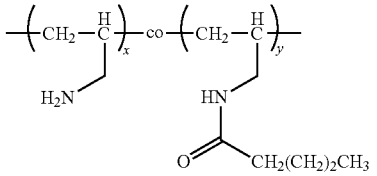

x/y = 3/97

[Analytical Results for Comparative Dispersing Agent (D-101)]

result of the amine value measurement: 52 mg KOH/g

Example 3

Pigment Dispersion Production Examples

[Pigment Dispersion (Cy-1) Production Example]

30 parts of Pigment Blue 15:3, 15 parts of Vylon V-280 (polyester resin, Toyobo Co., Ltd.), 180 parts of tetrahydrofuran, and 130 parts of glass beads (Ø1 mm) were mixed and were dispersed for 3 hours with an attritor [Nippon Coke & Engineering Co., Ltd.] followed by filtration on a mesh to obtain pigment dispersion (Cy-1).

[Pigment Dispersions (M-1), (Y-1), and (Bk-1) Production Example]

Pigment dispersions (M-1), (Y-1), and (Bk-1) were produced by the same method as in the Pigment Dispersion (Cy-1) Production Example, but changing the Pigment Blue 15:3 in pigment dispersion (Cy-1) to, respectively, Pigment Red 122, Pigment Yellow 155, and carbon black.

[Pigment Dispersion (Cy-2) Production Example]

30 parts of Pigment Blue 15:3, 15 parts of a styrene homopolymer (Mw=20,000), 180 parts of styrene monomer, and 130 parts of glass beads (Ø1 mm) were mixed and were dispersed for 3 hours with an attritor [Nippon Coke & Engineering Co., Ltd.] followed by filtration on a mesh to obtain pigment dispersion (Cy-2).

Example 4

Ultraviolet-Curable Liquid Developer Production Examples

An example is first provided of a method of producing the ultraviolet-curable liquid developer using a toner particle dispersion provided by a wet pulverization method.

[Ultraviolet-Curable Liquid Developer (T-1) Production Example]

25 parts of Diacron FC-1565 (polyester resin, acid value=6 mg KOH/g, Mitsubishi Rayon Co., Ltd.) as binder resin and 75 parts of dodecyl vinyl ether were introduced into a separable flask, and, while stirring at 200 rpm with a Three-One Motor, the temperature was raised over 1 hour to 130° C. on an oil bath. After holding for 1 hour at 130° C., gradual cooling was carried out at a rate of −15° C. per 1 hour to produce a toner particle precursor. The obtained toner particle precursor was a white paste.

60 parts of this toner particle precursor, 5.0 parts of Pigment Blue 15:3, 0.20 parts of aluminum tristearate, 0.75 parts of dispersing agent (D-8), and 35.45 parts of dodecyl vinyl ether were filled into a planetary bead mill (Classic Line P-6/Fritsch) along with zirconia beads having a diameter of 0.5 mm, and pulverization was carried out at 200 rpm for 4 hours at room temperature to obtain a toner particle dispersion.

An ultraviolet-curable liquid developer (T-1) was obtained by adding, to 10 parts of this toner particle dispersion, 0.10 parts of Lecinol S-10 (hydrogenated lecithin, Nikko Chemicals Co., Ltd.), 90 parts of cyclohexanedimethanol divinyl ether as a polymerizable liquid monomer, 0.30 parts of the photopolymerization initiator represented by formula (A-1) below, and 1 parts of KAYAKURE-DETX-S(Nippon Kayaku Co., Ltd.).

(A-1)

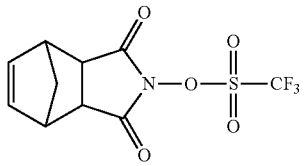

An example is provided below of a method of producing the ultraviolet-curable liquid developer using a toner particle dispersion provided by a miniemulsion polymerization method.

[Ultraviolet-Curable Liquid Developer (T-2) Production Example]

Using a T.K. Homomixer (Primix Corporation) high-speed stirring apparatus, 68 parts of styrene monomer, 7.0 parts of acrylic acid, 130 parts of pigment dispersion (Cy-2), 0.70 parts of n-octyl mercaptan, 5 parts of dispersing agent (D-8), 2 parts of BONTRON E-108 (aluminum salicylate compound, Orient Chemical Industries Co., Ltd.), and 0.10 parts of divinylbenzene monomer were dissolved and dispersed to uniformity at 5,000 rpm to obtain a solution.

0.6 parts of sodium dodecylbenzenesulfonate and 1,000 parts of deionized water were added to a beaker; the aforementioned solution was then added dropwise; and this system was mixed and dispersed for 1 hour at 80° C. using a "CLEARMIX" mechanical disperser (M Technique Co., Ltd.) to prepare a dispersion. This was followed by the rapid addition of this dispersion to a separable flask and regulation of the temperature to 80° C. while stirring at a stirring rate of 230 rpm under a nitrogen current. To this mixture was then added an initiator solution prepared by the dissolution of 6.0 g of potassium persulfate in 250 mL deionized water; polymerization was carried out by heating and stirring for 2 hours at 80° C.; and cooling this to 30° C. then provided a fine polymer particle dispersion.

350 parts of cyclohexanedimethanol divinyl ether was added to this fine polymer particle dispersion followed by removal of the water with an evaporator to obtain a toner particle dispersion.

0.35 parts of Lecinol S-10, 0.70 parts of the photopolymerization initiator (A-1), and 3.5 parts of KAYAKURE-DETX-S were added to this toner particle dispersion to obtain ultraviolet-curable liquid developer (T-2).

An example is provided below of a method of producing the ultraviolet-curable liquid developer using a toner particle dispersion provided by a coacervation method.

[Ultraviolet-Curable Liquid Developer (T-3) Production Example]

6.3 parts of Diacron FC-1565 as binder resin, 22 parts of tetrahydrofuran (SP value=9.52), 11 parts of pigment dispersion (Cy-1), and 2 parts of dispersing agent (D-8) were introduced into a separable flask, and, while stirring at 200 rpm with a Three-One Motor, 23 parts of cyclohexanedimethanol divinyl ether (B-1) (SP value=8.53) was added over 30 minutes. This was stirred in this condition for 1 hour followed by distillative removal of the tetrahydrofuran with an evaporator to obtain a toner particle dispersion.

0.046 parts of Lecinol S-10, 0.23 parts of the photopolymerization initiator (A-1), and 1.2 parts of KAYAKURE-DETX-S were added to this toner particle dispersion to obtain ultraviolet-curable liquid developer (T-3).

[Ultraviolet-Curable Liquid Developers (T-4) to (T-21) Production Example]

Ultraviolet-curable liquid developers (T-4) to (T-21) were produced by the same method as in the Ultraviolet-Curable Liquid Developer (T-3) Production Example, but respectively changing the binder resin, pigment dispersion, dispersing agent, and hydrophobic cationically polymerizable liquid monomer in the ultraviolet-curable liquid developer (T-3) as shown in Table 1.

TABLE 1

Ultraviolet-curable liquid developers by the coacervation method

| ultraviolet-curable liquid developer | dispersing agent: dispersing agent | dispersing agent: amine value | resin: resin | resin: acid value | pigment dispersion | hydrophobic cationically polymerizable liquid monomer |
|---|---|---|---|---|---|---|
| (T-3) | (D-8) | 5 | FC-1565 | 6 | (Cy-1) | (B-1) |
| (T-4) | (D-1) | 110 | FC-1565 | 6 | (Cy-1) | (B-1) |
| (T-5) | (D-2) | 105 | FC-1565 | 6 | (Cy-1) | (B-1) |
| (T-6) | (D-3) | 25 | FC-1565 | 6 | (Cy-1) | (B-1) |
| (T-7) | (D-4) | 11 | FC-1565 | 6 | (Cy-1) | (B-1) |
| (T-8) | (D-5) | 28 | FC-1565 | 6 | (Cy-1) | (B-1) |
| (T-9) | (D-6) | 28 | FC-1565 | 6 | (Cy-1) | (B-1) |
| (T-10) | (D-7) | 10 | FC-1565 | 6 | (Cy-1) | (B-1) |
| (T-11) | (D-9) | 3 | FC-1565 | 6 | (Cy-1) | (B-1) |
| (T-12) | (D-10) | 40 | FC-1565 | 6 | (Cy-1) | (B-1) |
| (T-13) | (D-11) | 62 | FC-1565 | 6 | (Cy-1) | (B-1) |
| (T-14) | (D-8) | 5 | FC-1981 | 5 | (Cy-1) | (B-1) |
| (T-15) | (D-8) | 5 | (P-1) | 112 | (Cy-1) | (B-1) |
| (T-16) | (D-8) | 5 | (P-2) | 43 | (Cy-1) | (B-1) |
| (T-17) | PB-817 | 15 | FC-1565 | 6 | (Cy-1) | (B-1) |
| (T-18) | (D-8) | 5 | FC-1565 | 6 | (Bk-1) | (B-1) |
| (T-19) | (D-8) | 5 | FC-1565 | 6 | (M-1) | (B-1) |
| (T-20) | (D-8) | 5 | FC-1565 | 6 | (Y-1) | (B-1) |
| (T-21) | (D-8) | 5 | FC-1565 | 6 | (Cy-1) | (B-2) |

[In the table, FC-1981 refers to Diacron FC-1981 (polyester resin, acid value=5 mg KOH/g, Mitsubishi Rayon Co., Ltd.). PB-817 refers to Ajisper BP-817 (reaction product of polyallylamine and 12-hydroxystearic acid self-condensate, for more detail a copolymer of formula (3) and formula (5); in formula (5), L is a methylene group, $R_2$ is —$(CH_2)_{10}CH((CH_2)_5CH_3)$—, and n is 6; amine value=15; Ajinomoto Fine-Techno Co., Ltd.). (B-1) and (B-2) refer, respectively, to cyclohexanedimethanol divinyl ether and trimethylolpropane trivinyl ether.]

Comparative Example 2

Comparative Ultraviolet-Curable Liquid Developer Production Examples

[Production Examples of Comparative Ultraviolet-Curable Liquid Developers (T-101) to (T-103)]

Comparative ultraviolet-curable liquid developers (T-101) to (T-103) were produced by the same method as in the Ultraviolet-Curable Liquid Developer (T-3) Production Example, but respectively changing the binder resin and dispersing agent in the ultraviolet-curable liquid developer (T-3) as shown in Table 2.

TABLE 2

Comparative ultraviolet-curable liquid developers

| ultraviolet-curable liquid developer | dispersing agent: dispersing agent | dispersing agent: amine value | resin: resin | resin: acid value | pigment dispersion |
|---|---|---|---|---|---|
| (T-101) | (D-8) | 5 | V220 | 2 | (Cy-1) |
| (T-102) | S13940 | 228 | FC-1565 | 6 | (Cy-1) |
| (T-103) | (D-101) | 52 | FC-1565 | 6 | (Cy-1) |

[In the table, 513940 is Solsperse 13940 (reaction product of polyethylenepolyamine and the self-condensate of 12-hydroxystearic acid, dispersing agent: 40% concentration, The Lubrizol Corporation). With regard to the amino groups obtained from the reaction product of polyethylenepolyamine and the self-condensate of 12-hydroxystearic acid, outside of the amino group in terminal position these are all secondary amino groups or tertiary amino groups. That is, a primary amino group at other than the terminal position is not present. V220 is Vylon 220 (polyester resin, acid value<2 mg KOH/g, Toyobo Co., Ltd.).]

Example 5

The ultraviolet-curable liquid developers (T-1) to (T-20) obtained in accordance with the present invention were evaluated by the following methods.

[Measurement of the Dispersion Stability]

The ultraviolet-curable liquid developer was stored for 1 month at 40° C. Both before and after storage, the toner particle diameter was measured using a Microtrac HRA (X-100) particle size distribution analyzer (Nikkiso Co., Ltd.); the measurement was carried out as the volume-based average particle diameter using a range setting of 0.001 μm to 10 μm. The toner particle dispersion stability was evaluated based on the ratio between the toner particle diameter post-versus-pre-storage (toner particle diameter post-storage/toner particle diameter pre-storage).

The evaluation criteria for the dispersion stability are given below. In this evaluation, a score of 3 or higher was rated as good.

5: (toner particle ratio post-versus-pre-storage)≤1.1

4: 1.1<(toner particle diameter ratio post-versus-pre-storage)≤1.2

3: 1.2<(toner particle diameter ratio post-versus-pre-storage)≤1.5

2: 1.5<(toner particle diameter ratio post-versus-pre-storage)≤2.0

1: 2.0<(toner particle diameter ratio post-versus-pre-storage)≤

[Measurement of the Developing Performance]

Development was carried out by the following method using the ultraviolet-curable liquid developers obtained in accordance with the present invention. A developing apparatus 50C as shown in FIG. 1 was used for the apparatus.

(1) A developing roller 53C, a photosensitive drum 52C, and an intermediate transfer roller 61C were separated from each other and these were rotated in a noncontact condition in the direction of the arrows in FIG. 1. The rotation rate here was 250 mm/sec.

(2) The developing roller 53C and the photosensitive drum 52C were brought into contact at a prescribed pressing pressure and a bias was established using a DC power source. Since the developing bias is desirably in the range from 100 to 400 V, 200 V was used.

(3) The photosensitive drum 52C and the intermediate transfer roller 61C were brought into contact at a prescribed pressing pressure and a bias was established using the aforementioned DC power source. The transfer bias was made 1000 V.

(4) The liquid developer at a uniform concentration (toner particle concentration of 2 mass %) was supplied onto a film-forming roller, and the image on the intermediate transfer member 60C was evaluated.

The evaluation criteria for the developing performance are given below. In this evaluation, a score of 3 or higher was rated as good.

5: a high-density, high-definition image was obtained
4: some image density non-uniformity is present, or some image blurring is seen
3: image density non-uniformity and/or image blurring is conspicuous, but development is still recognized
2: severe image density non-uniformity and/or image blurring was produced and development was unsatisfactory
1: development could not be carried out

[Measurement of the Fixing Performance]

The ultraviolet-curable liquid developer was coated (thickness=8.0 μm) at 25° C. with a wire bar (No. 6) on a polyethylene terephthalate film and was exposed to a dose of 45 mJ/cm$^2$ (measurement wavelength=365 nm) from a high-pressure mercury lamp with a lamp output of 120 mW/cm$^2$ to form a cured film. The presence/absence of surface tack (stickiness) was scored by finger contact with the film surface immediate after curing.

The evaluation criteria for the fixing performance are given below. In this evaluation, a score of 3 or higher was rated as good.

—$C_nH_{2n}$ 3: tack is completely undetected
2: slight tack is detected
1: the film peels off upon finger contact, or curing has not occurred The results of the evaluations are given in Table 3.

Comparative Example 3

The toner particle diameter, developing performance, and fixing performance were evaluated for the comparative ultraviolet-curable liquid developers (T-101) to (T-103) using the same methods as in Example 5. The results of these evaluations are given in Table 3.

TABLE 3

Results of the evaluations of the ultraviolet-curable liquid developers

| ultraviolet-curable liquid developer | dispersion stability | developing performance | fixing performance |
|---|---|---|---|
| (T-1) | 3 | 5 | 3 |
| (T-2) | 3 | 5 | 3 |
| (T-3) | 5 | 5 | 3 |
| (T-4) | 3 | 3 | 3 |

TABLE 3-continued

Results of the evaluations of the ultraviolet-curable liquid developers

| ultraviolet-curable liquid developer | dispersion stability | developing performance | fixing performance |
|---|---|---|---|
| (T-5) | 4 | 3 | 3 |
| (T-6) | 4 | 5 | 3 |
| (T-7) | 3 | 5 | 3 |
| (T-8) | 4 | 5 | 3 |
| (T-9) | 4 | 5 | 3 |
| (T-10) | 5 | 5 | 3 |
| (T-11) | 5 | 5 | 3 |
| (T-12) | 5 | 5 | 3 |
| (T-13) | 5 | 4 | 3 |
| (T-14) | 5 | 5 | 3 |
| (T-15) | 4 | 5 | 3 |
| (T-16) | 4 | 5 | 3 |
| (T-17) | 5 | 5 | 3 |
| (T-18) | 5 | 5 | 3 |
| (T-19) | 5 | 5 | 3 |
| (T-20) | 5 | 5 | 3 |
| (T-21) | 5 | 5 | 3 |
| (T-101) | could not be evaluated | | |
| (T-102) | 3 | 3 | 1 |
| (T-103) | 1 | 3 | 3 |

[With reference to the comparative ultraviolet-curable liquid developer (T-101) in the table, in this case a toner particle dispersion could not be obtained and the evaluations thus could not be carried out.]

As is clear from Table 3, the ultraviolet-curable liquid developer of the present invention provides a good dispersion stability of the toner particle in the liquid developer and a good polymerizability by the polymerizable liquid monomer. As is also clear from Table 3, an ultraviolet-curable liquid developer that exhibits a good toner particle dispersion stability and a good polymerizability by the polymerizable liquid monomer can be obtained by producing this ultraviolet-curable liquid developer by using the coacervation technique-based method disclosed in the present invention to produce the toner particle dispersion.

An ultraviolet-curable liquid composition that exhibits a good toner particle dispersion stability in the liquid developer and a good polymerizability by the polymerizable liquid monomer can be obtained by using the ultraviolet-curable liquid composition of the present invention. Moreover, an ultraviolet-curable inkjet ink, a liquid developer for ultraviolet-curing wet electrophotography, and an ultraviolet-curable electrostatic inkjet ink can be obtained which in each case have a high sensitivity, a low viscosity, an excellent storage stability, and a high safety; provide a high optical density; and, in combination with the preceding, provide a satisfactory fixing performance and resist image blurring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107304, filed May 27, 2015, which is hereby incorporated by reference herein in its entirety.

What is claimed is:

1. An ultraviolet-curable liquid developer comprising a hydrophobic cationically polymerizable liquid monomer, a photopolymerization initiator, a toner particle insoluble in the liquid monomer, and a toner particle dispersing agent, wherein the toner particle comprises a binder resin having an acid value of at least 5 mg KOH/g;

the toner particle dispersing agent is a polymer containing at least both a monomer unit represented by formula (1) and a monomer unit represented by formula (2); and the toner particle dispersing agent has a monomer unit represented by formula (1) at a position other than the terminal position:

$$-(K)- \quad (1)$$

where K is a unit having a primary amino group $$-(Q)- \quad (2)$$

where Q is a unit having an alkyl group having at least 6 carbons, which may be substituted, a cycloalkyl group having at least 6 carbons, which may be substituted, an alkylene group having at least 6 carbons, which may be substituted, or a cycloalkylene group having at least 6 carbons, which may be substituted.

2. The ultraviolet-curable liquid developer according to claim 1, wherein Q is a unit having an alkyl group having at least 12 carbons, which may be substituted, a cycloalkyl group having at least 12 carbons, which may be substituted, an alkylene group having at least 12 carbons, which may be substituted, or a cycloalkylene group having at least 12 carbons, which may be substituted.

3. The ultraviolet-curable liquid developer according to claim 1, wherein the monomer unit represented by formula (1) is represented by formula (3), and the monomer unit represented by formula (2) is represented by formula (4):

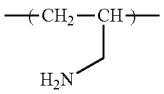

(3)

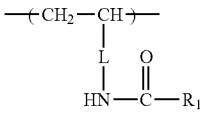

(4)

where $R_1$ is an alkyl group having at least 6 carbons, which may be substituted, and L is a divalent linking group.

4. The ultraviolet-curable liquid developer according to claim 1, wherein the monomer unit represented by formula (1) is represented by formula (3), and the monomer unit represented by formula (2) is represented by formula (5):

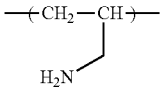

(3)

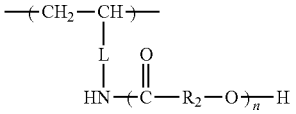

(5)

where $R_2$ is an alkylene group having at least 6 carbons, which may be substituted; n is an integer equal to or greater than 1; and L is a divalent linking group.

5. The ultraviolet-curable liquid developer according to claim 1, wherein the polymer further has a monomer unit represented by formula (1) at the terminal position.

6. The ultraviolet-curable liquid developer according to claim 1, wherein the toner particle dispersing agent has an amine value of from 3 to 110 mg KOH/g.

7. A method of producing an ultraviolet-curable liquid developer comprising a hydrophobic cationically polymerizable liquid monomer, a photopolymerization initiator, a toner particle insoluble in the liquid monomer, and a toner particle dispersing agent, comprising the steps of:

a step of obtaining a mixture by dissolving or dispersing at least a pigment, a binder resin, and a toner particle dispersing agent in a solvent that dissolves the binder resin; and a step of precipitating the binder resin contained in the mixture in a dissolved state, by mixing into the mixture a hydrophobic cationically polymerizable liquid monomer that does not dissolve the binder resin, wherein the toner particle comprises a binder resin having an acid value of at least 5 mg KOH/g, the toner particle dispersing agent is a polymer containing at least both a monomer unit represented by formula (1) and a monomer unit represented by formula (2), and the toner particle dispersing agent has a monomer unit represented by formula (1) at a position other than the terminal position:

$$-(K)- \quad (1)$$

where K is a unit having a primary amino group $$-(Q)- \quad (2)$$

where Q is a unit having an alkyl group having at least 6 carbons, which may be substituted, a cycloalkyl group having at least 6 carbons, which may be substituted, an alkylene group having at least 6 carbons, which may be substituted, or a cycloalkylene group having at least 6 carbons, which may be substituted.

8. The method of producing an ultraviolet-curable liquid developer according to claim 7, wherein the polymer further has a monomer unit represented by formula (1) at the terminal position.

9. An ultraviolet-curable liquid developer comprising:

a hydrophobic cationically polymerizable liquid monomer;

a photopolymerization initiator;

a toner particle insoluble in the liquid monomer; and a toner particle dispersing agent, wherein the toner particle comprises a binder resin having an acid value of at least 5 mg KOH/g, the toner particle dispersing agent has an amine value of from 3 to 110 mg KOH/g, and the toner particle dispersing agent is a polymer containing at least both a monomer unit represented by formula (1) and a monomer unit represented by formula (2)

$$-(K)- \quad (1)$$

where K is a unit having a primary amino group, $$-(Q)- \quad (2)$$

where Q is a unit having an alkyl group having at least 6 carbons, which may be substituted, a cycloalkyl group having at least 6 carbons, which may be substituted, an alkylene group having at least 6 carbons, which may be substituted, or a cycloalkylene group having at least 6 carbons, which may be substituted.

10. A method of producing an ultraviolet-curable liquid developer comprising a hydrophobic cationically polymerizable liquid monomer, a photopolymerization initiator, a toner particle insoluble in the liquid monomer, and a toner particle dispersing agent, comprising the steps of:

a step of obtaining a mixture by dissolving or dispersing at least a pigment, a binder resin, and a toner particle dispersing agent in a solvent that dissolves the binder resin; and a step of precipitating the binder resin contained in the mixture in a dissolved state, by mixing into the mixture a hydrophobic cationically polymerizable liquid monomer that does not dissolve the binder resin, wherein the toner particle comprises a binder resin having an acid value of at least 5 mg KOH/g, the toner particle dispersing agent has an amine value of from 3 to 110 mg KOH/g, and the toner particle dispersing agent is a polymer containing at least both a monomer unit represented by formula (1) and a monomer unit represented by formula (2)

$$\text{-}(K)\text{-} \quad (1)$$

where K is a unit having a primary amino group, $$\text{-}(Q)\text{-} \quad (2)$$

where Q is a unit having an alkyl group having at least 6 carbons, which may be substituted, a cycloalkyl group having at least 6 carbons, which may be substituted, an alkylene group having at least 6 carbons, which may be substituted, or a cycloalkylene group having at least 6 carbons, which may be substituted.

* * * * *